US005429198A

United States Patent [19]

Anderson et al.

[11] Patent Number: 5,429,198

[45] Date of Patent: Jul. 4, 1995

[54] DOWN REAMING APPARATUS HAVING HYDRAULICALLY CONTROLLED STABILIZER

[75] Inventors: Llewellan Anderson, Renton; Thomas C. Whitehouse, Puyallup, both of Wash.

[73] Assignee: The Robbins Company, Kent, Wash.

[21] Appl. No.: 134,802

[22] Filed: Oct. 12, 1993

Related U.S. Application Data

[63] Continuation-in-part of Ser. No. 859,321, Mar. 27, 1992, Pat. No. 5,325,932.

[51] Int. Cl.[6] ..... E21C 9/00; E21B 17/10

[52] U.S. Cl. ..... 175/230; 175/325.3

[58] Field of Search ..... 299/31, 33; 175/53, 175/230, 325.2, 325.3, 325.5; 166/241.6

[56] References Cited

U.S. PATENT DOCUMENTS

| | | | |
|---|---|---|---|
| 879,822 | 2/1908 | Karns | 175/325.3 |
| 3,485,309 | 12/1969 | Lawrence et al. | 175/320 |
| 3,840,272 | 10/1974 | Crane et al. | 299/56 |
| 3,965,995 | 6/1976 | Sugden | 175/57 |
| 3,999,616 | 12/1976 | Crane et al. | 173/32 |
| 4,009,909 | 3/1977 | Robbins et al. | 299/56 |
| 4,190,123 | 2/1980 | Roddy | 175/325.3 |
| 4,270,618 | 6/1981 | Owens | 175/57 |
| 4,381,038 | 4/1983 | Sugden | 175/325.3 X |
| 4,646,853 | 3/1987 | Sugden et al. | 175/94 |
| 4,697,652 | 10/1987 | Walk | 175/325.5 |
| 5,199,515 | 4/1993 | Sinclair et al. | 175/213 |

FOREIGN PATENT DOCUMENTS

| | | | |
|---|---|---|---|
| 1241386 | 6/1967 | Germany | 175/53 |
| 1346804 | 10/1987 | U.S.S.R. | 175/53 |

*Primary Examiner*—David J. Bagnell

*Attorney, Agent, or Firm*—Graybeal Jackson Haley & Johnson

[57] ABSTRACT

A down reaming apparatus has an upper stabilizer which supports the down reaming apparatus in the bored hole. A plurality of shoe assemblies are radially attached to the hub of the upper stabilizer. The shoe assemblies are biased against a bored shaft wall by pressurized cylinders which allow limited return movement with resistance of the shoe assemblies. A weight assembly comprising a plurality of stacked plates is secured to the frame of the down reaming apparatus and has manways therethrough which allow passage of workers. A lower stabilizer provides additional support for the down reaming apparatus. The lower stabilizer also includes shoe assemblies that are biased against the bored shaft wall by a pressurized cylinder.

31 Claims, 16 Drawing Sheets

DOWN REAMING APPARATUS HAVING HYDRAULICALLY CONTROLLED STABILIZER

CROSS REFERENCE TO RELATED APPLICATION

This application is a continuation-in-part of U.S. patent application No. 07/859,321, entitled Down Reaming Apparatus, filed Mar. 27, 1992 which issued as U.S. Pat. No. 5,325,932, on Jul. 5, 1994.

BACKGROUND OF THE INVENTION

The invention is in the field of rock boring machines, and more specifically such machines for reaming substantially vertical holes, or holes at a slight angle from true vertical, by initiating rock boring at ground level and boring a predetermined distance underground. No known down reaming apparatus is capable of boring substantially larger holes (preferably having a diameter of at least four meters) in a substantially continuous manner.

U.S. Pat. No. 3,965,995 issued to Sugden discloses a machine for boring a large diameter blind hole in a sequential, non-continuous manner. The cutterwheel is mounted at the lower end of the machine for rotation about a horizontal tubular support. A gripper assembly secures the machine against the tunnel wall while thrust cylinders thrust the rotatable cutterhead downwardly. As the machine is advanced, the cutterwheel is rotated to make a first cut in the shape of the leading portion of the cutterwheel. The cutterwheel is then retracted out from the cut and is rotated about the axis of the hole. This repositions the cutterwheel so that when it is advanced again, during the next cutting step, it will make a second cut which crosses the first. This procedure is repeated until the desired cross-sectional configuration (e.g. circular) of the hole is obtained. The above described sequential boring method employing a gripper assembly and thrust cylinders has been found to be time consuming and requires a complex and expensive machine. U.S. Pat. No. 3,965,995 lists numerous prior art shaft forming machines, the disclosures of which are incorporated herein by reference.

U.S. Pat. No. 4,270,618 issued to Owens teaches an earth boring apparatus which is used for boring a blind pilot hole of a relatively small diameter which is subsequently enlarged by raise boring. Initially, the earth boring apparatus is employed to bore a blind pilot hole. Then the apparatus is removed from the hole and a room is blasted at the blind end of the hole. Next, the pilot hole cutterhead is replaced by a reamer and the apparatus is again inserted into the hole. The reamer is an adjustable diameter type and its diameter is increased once it is within the blasted room. The diameter of the reamer is increased by a plurality of cutter carrying arms which swing outwardly from the axis of rotation of the reamer. The earth boring apparatus is then raised from the room upwardly towards the ground surface to bore a hole of the desired diameter.

Similarly, U.S. Pat. No. 4,646,853 issued to Sugden et al. discloses a shaft boring machine having step-wise operation. The machine includes a cutterwheel assembly having a substantially horizontal axis of rotation and having multiple peripherally mounted roller cutter units. Motors are provided for rotating the cutterwheel assembly about its horizontal axis. A cutterwheel carriage and vertical guide columns support the cutterwheel assembly and allow movement of the cutterwheel assembly in a vertical plane. A base frame supports the vertical guide columns. The base frame is slewed in a substantially horizontal plane by a slew drive system. Plunge cylinders mounted on the cutterwheel carriage and the base frame lower and raise the cutterwheel assembly in a vertical plane. A lower gripper ring stabilizes the machine in the shaft and includes a circular track for supporting the base frame and further includes a lower gripper cylinder system for holding the gripper ring stationary in the shaft. An upper gripper ring provides further stabilization of the machine in the shaft and includes an upper gripper cylinder system for holding the upper gripper ring stationary in the shaft. Walking cylinders are mounted on the lower and upper gripper rings for raising and lowering the rings. U.S. Pat. No. 4,646,853 discloses additional prior art patents pertaining to shaft boring machines, the disclosures of which are incorporated herein by reference.

U.S. Pat. No. 4,270,618 issued to Owens cites prior art patents for drilling machines located at an upper level which bore a large diameter hole in a single downward pass, drilling machines at an upper level which first drill a small pilot hole on a single downward pass and then enlarge the pilot hole in a single upward pass, and machines having expandable reamers. These prior art patents are incorporated herein by reference.

U.S. Pat. No. 3,840,272 issued to Crane et al.; U.S. Pat. No. 3,999,616 issued to Crane et al.; U.S. Pat. No. 4,009,909 issued to Robbins et al.; and patents cited therein disclose machines for upward tunneling, as opposed to down reaming.

A need thus exists for a down reaming apparatus capable of boring a large diameter hole in a substantially continuous manner.

A need also exists for this type of down reaming apparatus which is stabilized in the bored shaft by means of non-gripping stabilizer assemblies which allow vertical movement of the down reaming apparatus within the tunnel.

A need also exists for this type of down reaming apparatus in which a gear assembly is employed to multiply the torque transmitted from the drill string to the cutterhead.

A need also exists for this type of down reaming apparatus in which a weight assembly is secured on the frame of the down reaming apparatus such that loads from rotation of the cutterhead are transmitted through the frame and into the weight assembly.

A need also exists for this type of down reaming apparatus in which the weight stack has a manway therethrough for access by workers to the cutterhead for cutterhead repair and/or reconfiguration.

SUMMARY OF THE INVENTION

A down reaming apparatus attached to a drill string includes a frame and a rotatable cutterhead. Support for the down reaming apparatus in the tunnel is provided by an upper stabilizer and a lower stabilizer. The upper stabilizer includes an upper stabilizer hub circumferentially disposed around the drill string such that the drill string rotates relative to the upper stabilizer hub. A plurality of wheel assemblies are radially attached to the upper stabilizer hub. In a first embodiment, each of the wheel assemblies has rotatable tires adapted to be oriented against the tunnel wall and a rotatable overload wheel which contacts the tunnel wall to stabilize the down reaming apparatus upon compression of the tires. In a second embodiment, the upper stabilizer has shoe assemblies that are biased against the tunnel wall by pressurized pistons which allow limited return movement, with resistance, of the shoe assemblies.

The lower stabilizer provides additional support for the down reaming apparatus and includes a lower stabilizer hub below the cutterhead such that the cutterhead rotates relative to the lower stabilizer hub. In a first embodiment, a plurality of wheel assemblies are radially attached to the lower stabilizer hub. Each of the wheel assemblies has a wheel support pivotally attached to the lower stabilizer hub and spaced therefrom by a compressible bumper. The rotatable wheel on the wheel support reacts against the tunnel wall to stabilize the down reaming apparatus. In a second embodiment, the lower stabilizer has shoe assemblies that are biased against the tunnel wall by a pressurized piston which allows limited return movement, with resistance, of the shoe assemblies.

The weight assembly, comprising a plurality of stacked plates, is secured to the frame of the rock boring apparatus by a plurality of tie rods such that loads from bring with the cutterhead are transmitted through the frame and into the weight assembly. Manways in the weight assembly allow passage of workers therethrough.

In the preferred embodiment of the present invention, a torque multiplier assembly is located in the stabilizer hub and includes a rotatable input shaft attached to the drill string. A sun gear meshes with the input shaft, planet gears mesh with the sun gear and are supported by a planet carrier and a ring gear meshes with the planet gears. A rotatable output shaft either meshes with the ring gear while the planet carrier is held stable, or meshes with the planet carrier while the ring gear is held stable, to produce a torque component greater than that of the input shaft.

Preferably, each of the plates of the weight assembly is comprised of a plurality of wedge shaped sections which are radially offset from the adjoining layer of plates. Additionally, the plurality of tie rods are secured through the weight plates by a top plate brace, a bottom plate brace, and jacks which apply a compressive force against the plates to brace them on the frame of the down reaming appartus.

BRIEF DESCRIPTION OF THE DRAWINGS

These and other features of the present invention will be evident when considered in light of the following specification and drawing in which.

DETAILED DESCRIPTION OF THE PREFERRED EMBODIMENT

The present invention pertains to an apparatus for reaming, or boring, holes in rock. These holes are preferably substantially vertical holes but may also be oriented at a slight angle from true vertical. More particularly the present invention pertains to down reaming of relatively large holes through rock. The term down reaming pertains to the method of rock boring in which the reaming apparatus initiates rock boring downwardly, as opposed to raise boring in which the apparatus initiates boring a predetermined distance below ground level and is raised towards the earth's surface. The preferred system of down reaming employing the present invention contemplates first boring a relatively small hole (having a diameter of between about nine and fourteen inches) downwardly from the ground surface, or from an underground level, to a predetermined distance therebelow with an apparatus generally known in the art. Next, this initial down hole is expanded to a pilot hole (having a diameter of preferably between about two meters and four meters) by employing a raise boring apparatus known in the art. Finally, this pilot hole is expanded (preferably to a diameter of between about four meters and eight meters) by boring downwardly through this pilot hole from the ground surface to a predetermined location therebelow with a down reamer according to the present invention.

Figure 1:
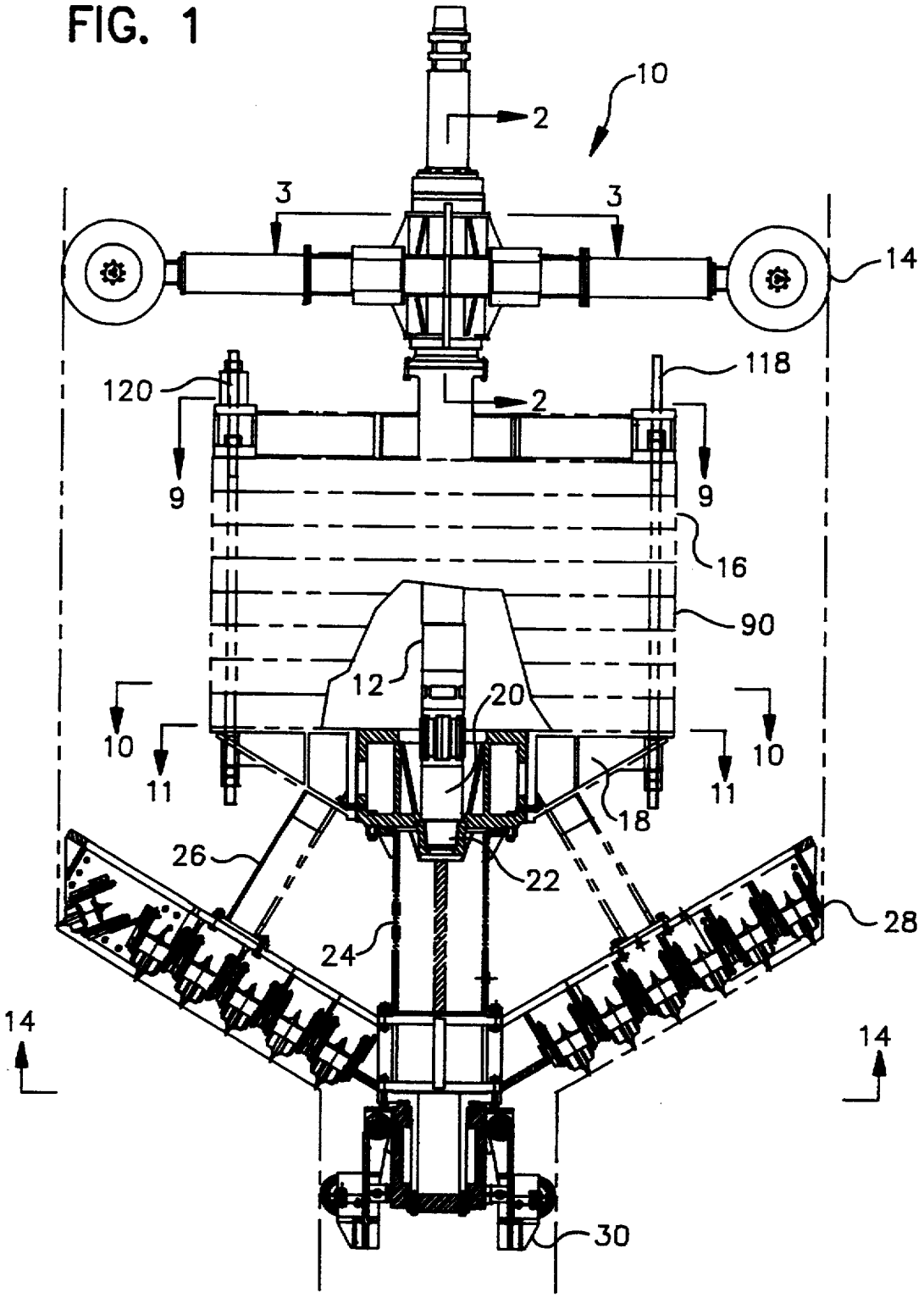
FIG. 1 is a side elevational view, partially in section, of a down boring apparatus typifying the present invention.

Referring to FIG. 1, such a down reamer 10 is secured to drill string 12 so that various elements of down reamer 10 as described herein rotate with drill string 12 while other elements of down reamer 10 are immobile relative to drill string 12. Drill string 12, which is rotated by a motor means known in the art, passes downwardly through upper stabilizer 14 and weight plates 16. Weight plates 16 are supported by spider 18, and the lower end of drill string 12, designated as stinger 20, passes into spider 18 and is fixedly secured in box insert 22 of spider 18. Torque tube 24 and spider support arms 26 are fixedly secured to the underside of spider 18 and to the upper portion of cutterhead 28. Lower stabilizer 30 is located directly under the central portion of cutterhead 28. As drill string 12 is rotated, upper stabilizer 14 and lower stabilizer 30, being braced against the wall of the bored hole, do not rotate with the drill string 12. Weight plates 16, spider 18, torque tube 24, spider support arms 26, and cutterhead 28 all rotate with drill string 12 in order to facilitate down reaming, with the boring of rock by cutterhead 28 augmented by the downward force applied thereon by the mass of weight plates 16.

Figure 2:
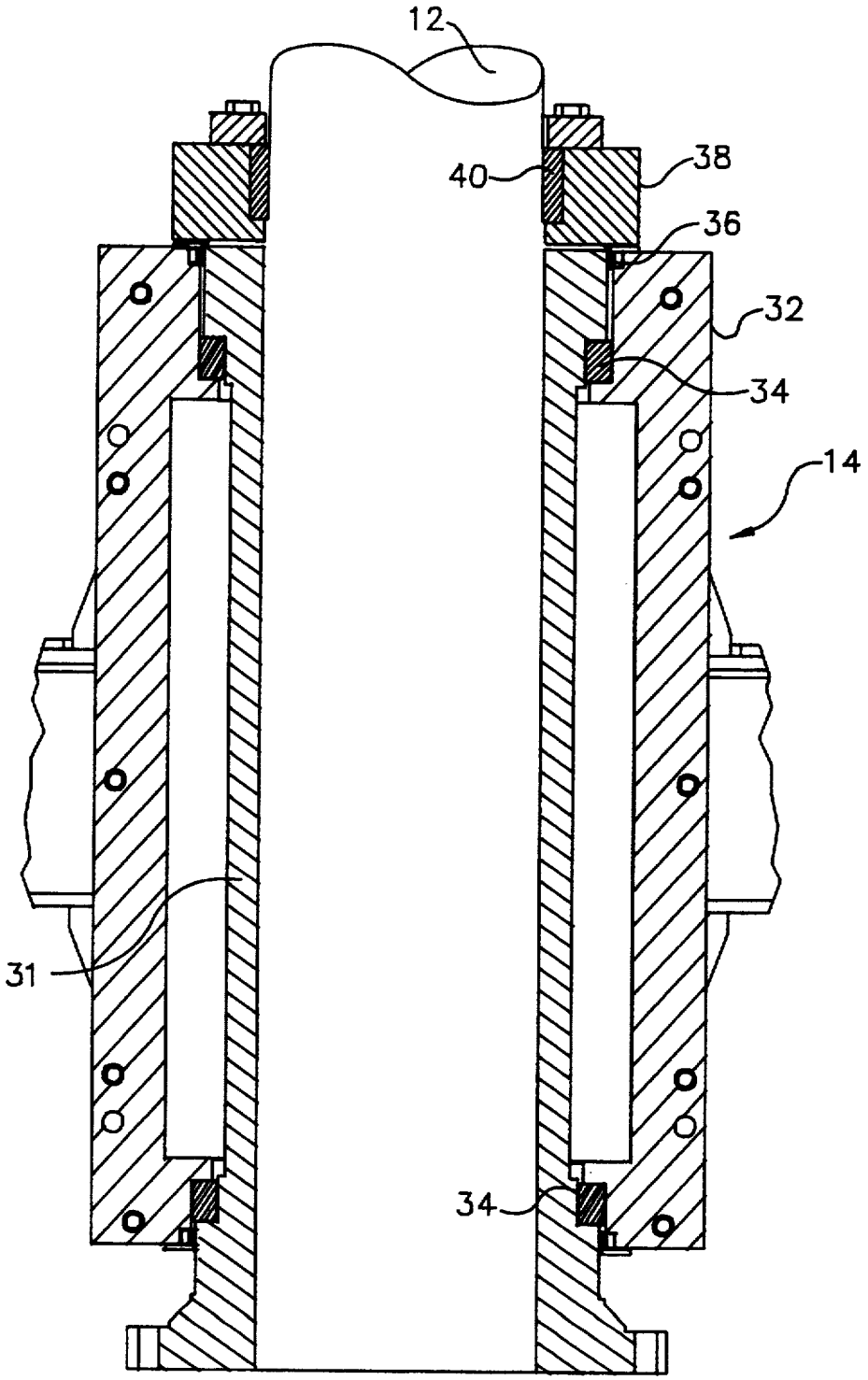
FIG. 2 is an enlarged cross-sectional view of the upper stabilizer hub of the down boring apparatus of FIG. 1 taken along lines 2—2.

Referring now to FIG. 2, the attachment of upper stabilizer 14 onto drill string 12, which allows relative rotation of drill string 12 and inner race 31 with respect to upper stabilizer 14, is now described in detail. Upper stabilizer hub 32 has stabilizer bearings 34 located at each end thereof. Stabilizer bearings 34 allow relative rotation of drill string 12 and inner race 31 with respect to upper stailizer 14. Upper stabilizer 14 is preferably divided into two halves which are joined around drill string 12 and connected by fastening means such as bolts or the like. The inner race 31 located adjacent the upper portion of upper stabilizer hub 32 has an annular seal 36 located therearound. Segmented clamp 38 is attached to drill string 12. Load isolator 40 is located between segmented clamp 38 and drill string 12.

Figure 3:
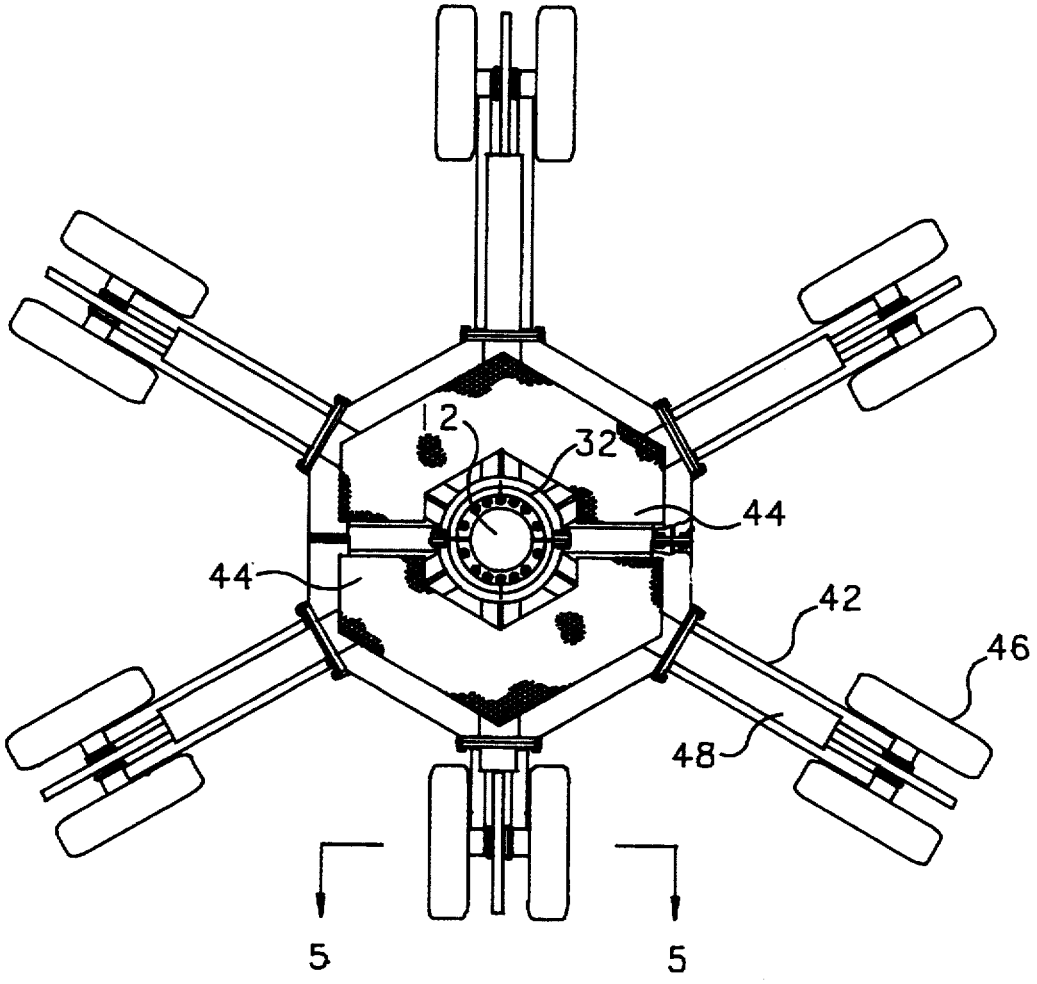
FIG. 3 is a cross-sectional view showing the upper stabilizer of the down boring apparatus of FIG. 1 taken along lines 3—3.
Figure 4:
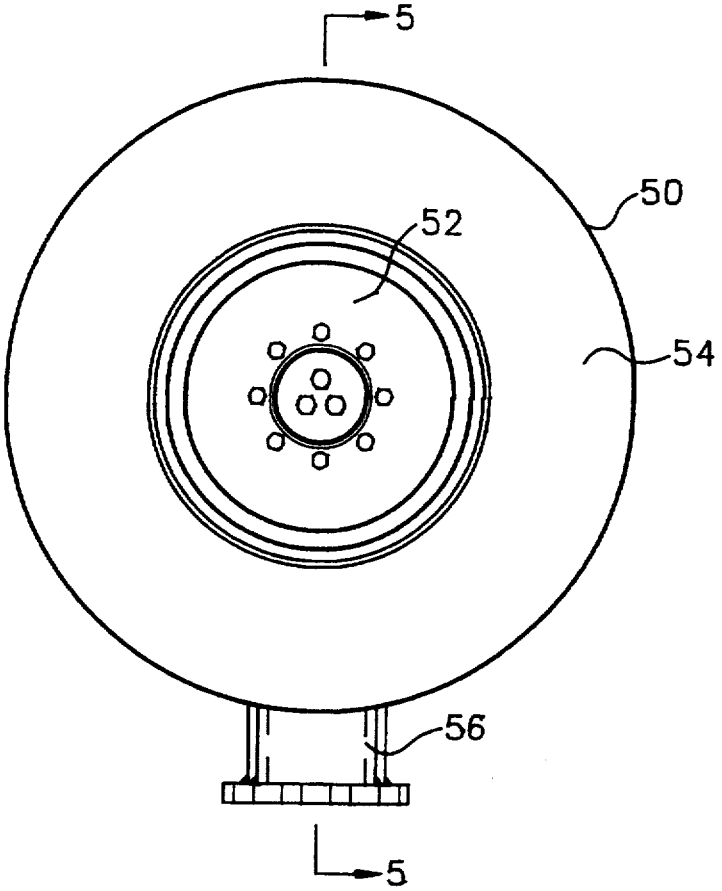
FIG. 4 is an enlarged view of the wheel assembly of the upper stabilizer of the down boring apparatus typifying the invention.
Figure 5:
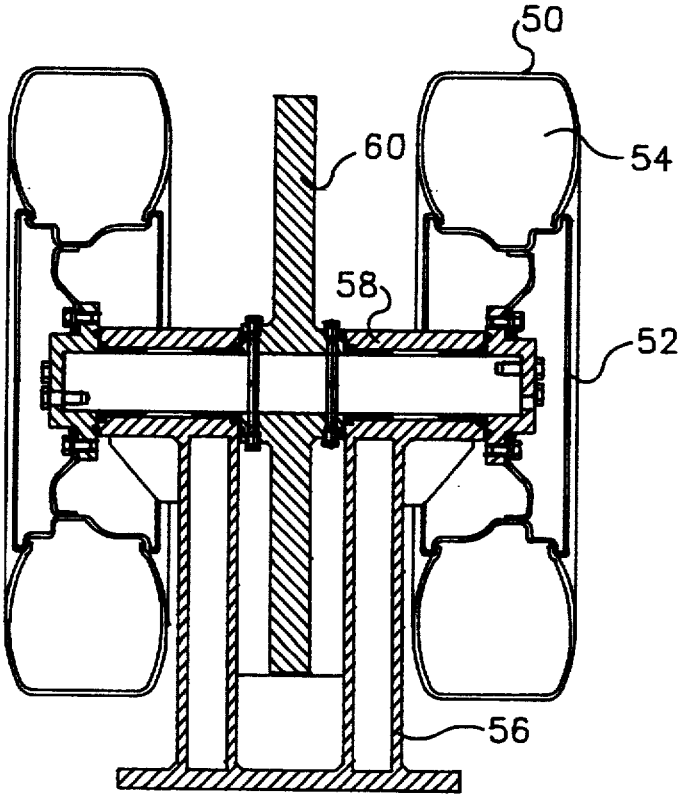
FIG. 5 is an enlarged cross-sectional view of the wheel assembly of the upper stabilizer of the down boring apparatus of FIG. 3 taken along lines 5—5.

Referring now to FIGS. 3 through 5, a first embodiment of the upper stabilizer 14 is described in detail. Upper stabilizer 14 is comprised of a plurality, preferably six, stabilizer legs 42 radially secured to upper stailizer hub 32. Disposed over stabilizer legs 42 are support plates 44. Stabilizer legs 42 include wheel assembly 46 and, optionally, leg extensions 48 bracketed between wheel assemblies 46 and upper stabilizer hub 32. Leg extensions can be of numerous predetermined lengths in order to allow down boring of tunnels of various diameters.

Referring to FIGS. 4 and 5, wheel assemblies 46 are comprised of a pair of wheels 50, each of which includes a hub 52 and a tire 54 which is preferably filled with an elastomeric material such as polyurethane. Alternatively, wheel 50 may be a dulled roller cutter known in the art which is attached to a compressible bumper described below. Hub 52 is rotatable around strut 56. Axle 58 connects hub 52 to strut 56. Located between the two wheels 50 on axle 58 is overload wheel 60 which, like wheels 50, is rotatable on axle 58 relative to struts 56. Overload wheel 60 is preferably comprised of a metal alloy or other nondeformable material. Overload wheel 60 provides additional support for down reamer 10 during boring operations where excessive side forces are encountered which overcompress tires 54 of wheel assemblies 46, due to, for example, narrowing of the bored hole diameter. Thus, it is readily apparent that overload wheel 60 has a radius which is less than that of wheels 50 and the difference between these two radii is selected based upon the amount of compression of wheels 50 that is desired during boring operations. Rotation of wheels 50 and overload wheels 60 allow vertical movement of down reamer 10 during stabilization.

Figure 6:
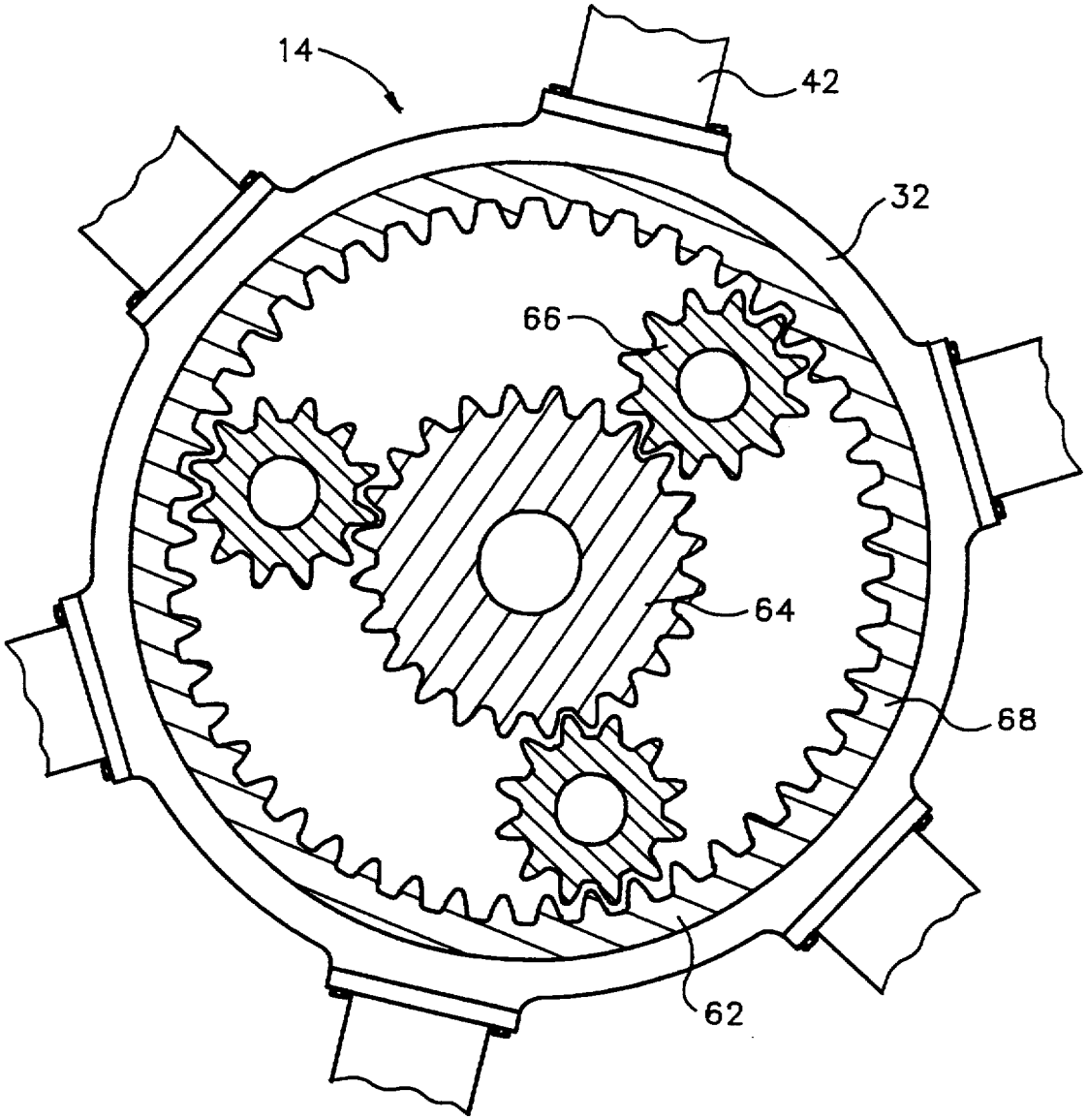
FIG. 6 is a partially exposed top view of a first embodiment of the upper stabiizer of the down boring apparatus typifying the present invention having a torque multiplier assembly.
Figure 7:
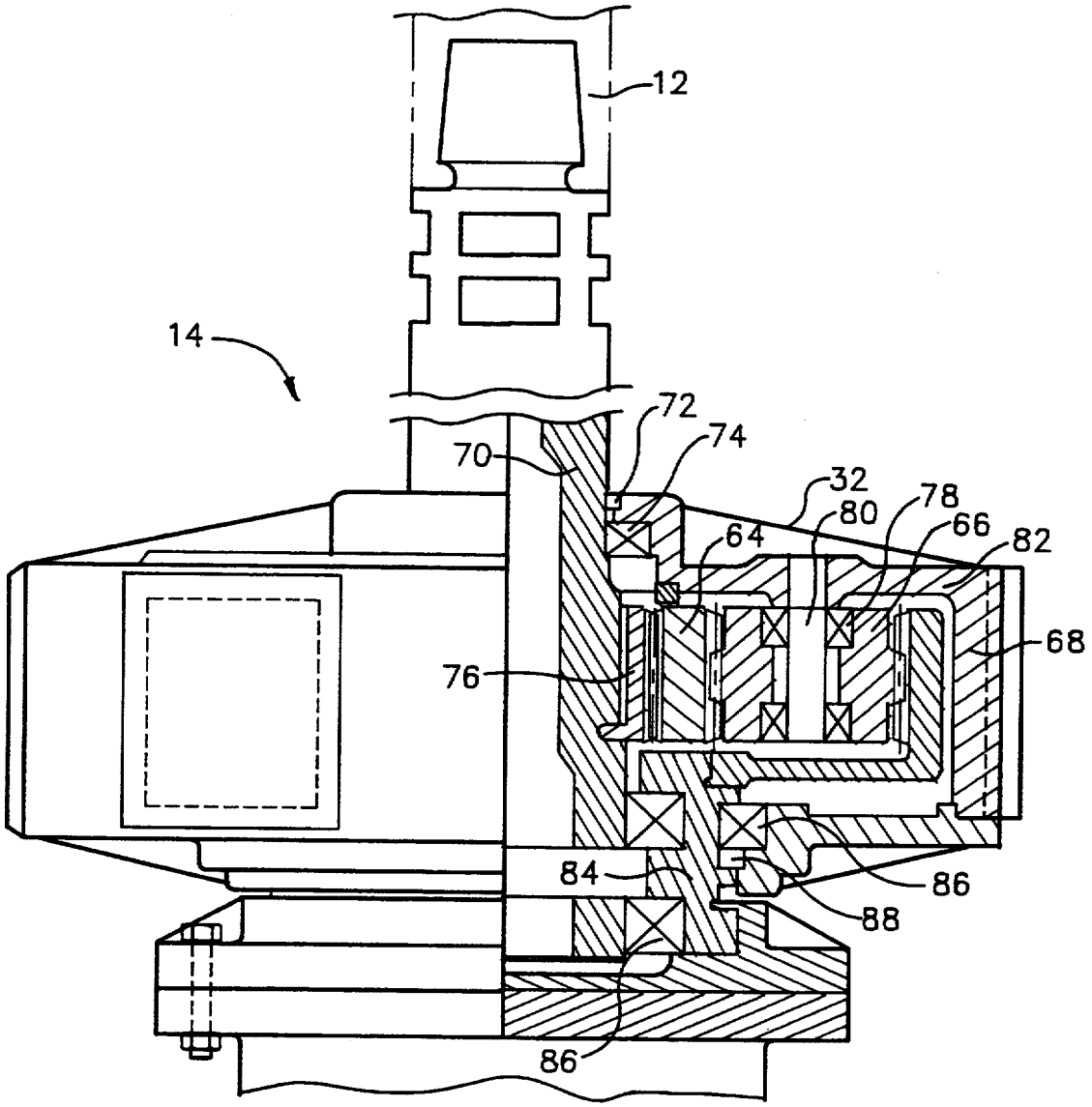
FIG. 7 is a side elevational view, partially in section, of the first embodiment of the upper stabilizer of the down boring apparatus of the present invention having a first embodiment of a torque multiplier assembly with the planet carrier fixed.
Figure 8:
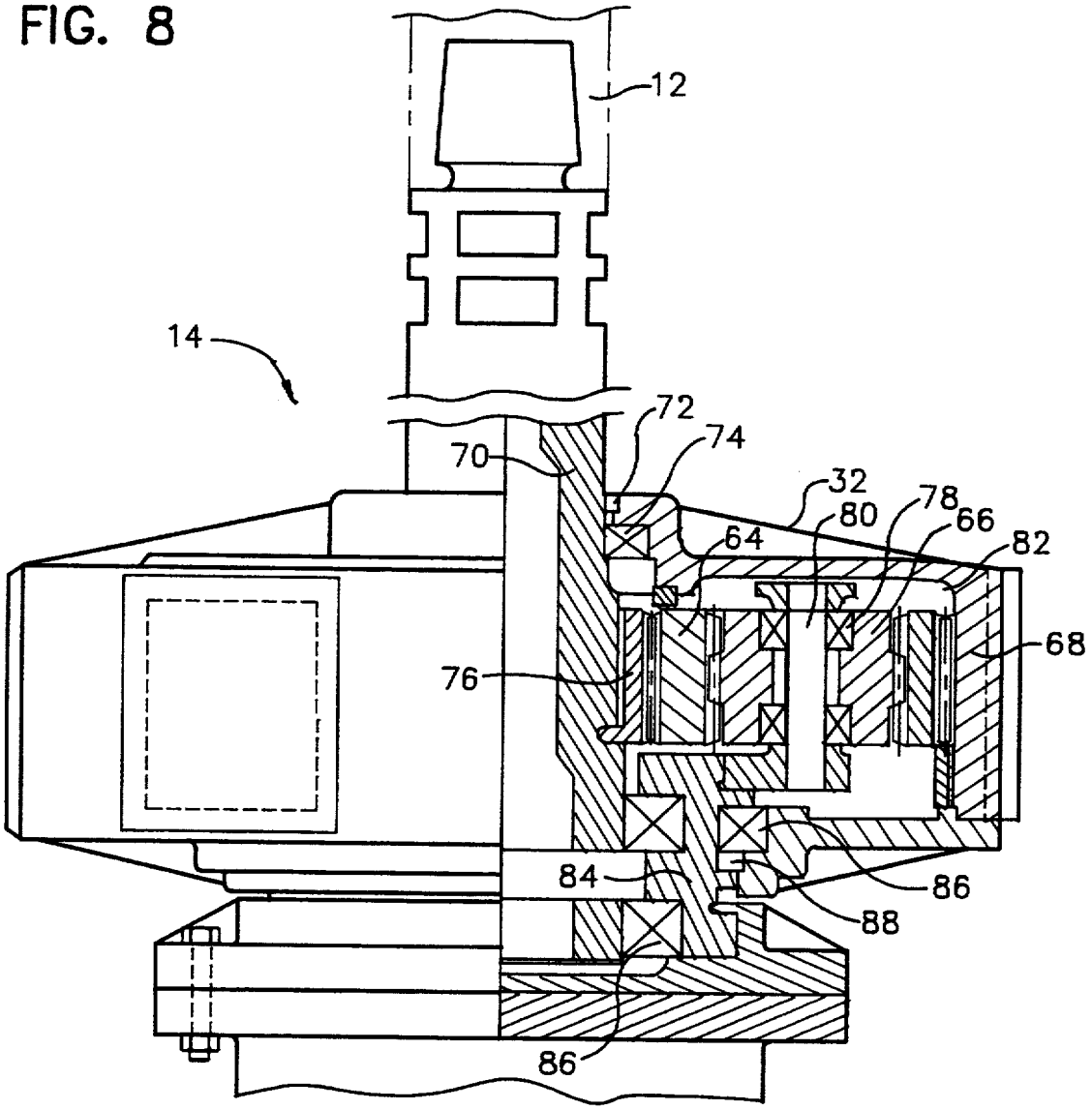
FIG. 8 is a side elevational view, partially in section, of the first embodiment of the upper stabilizer of a down boring apparatus typifying the present invention having a second embodiment of the torque multiplier assembly with the ring gear fixed.

Referring now to FIGS. 6 through 8, two optional torque multiplying gearing assemblies 62 for upper stabilizer 14 are disclosed. These two torque multiplier gearing assemblies 62 are configured to be located within upper stabilizer hub 32. The torque multiplier assembly 62 increases the torque from drill string 12 to cutterhead 28, and reduces the rate of rotation of cutterhead 28 as compared to that of drill string 12. Torque multiplication is desired because, to bore relatively larger diameter holes efficiently, it is necessary to employ greater torque than drill string 12 can transmit without breaking.

Referring specifically to FIG. 6, torque multiplier assembly 62 includes planetary gearing comprising a sun gear 64 axially oriented in upper stabilizer hub 32. Planet gears 66 mesh with sun gears 64. Preferably three planet gears 66 are employed but more or less can also be used in order to obtain a desired amount of torque multiplication. Planet gears 66 mesh with ring gear 68 located adjacent the external periphery of upper stabilizer hub 32. Referring to FIG. 7 a first embodiment of torque multiplier assembly 62 is shown in which approximately a 2:1 ratio for example, of torque multiplication is achieved by employing a fixed planet carrier and output from the ring gear. Specifically, input shaft 70 is attached to drill string 12 and has input shaft seal 72 and input shaft bearings 74 located adjacent thereto. Sun gear 64 meshes with input shaft 70 by means of spline 76. As stated above, sun gear 64 also meshes with planet gears 66, which in turn mesh with ring gear 68. Planet gears 66 rotate on planet gear bearings 78 around planet gear shaft 80. Planet gears 66 are supported by planet carrier 82. As previously stated, planet carrier 82 is fixed in this embodiment. Planet gears 66 in turn mesh with ring gear 68, the output of which is transmitted to output shaft 84. Output shaft 84 is located adjacent the lower portion of upper stabilizer hub 32 and is rotatable by means of output shaft bearings 86. Output shaft seals 88 are located adjacent output shaft 84. In operation, rotation of drill string 12 causes rotation of input shaft 70, spline 76, sun gear 64, planet gear 66, ring gear 68 and output shaft 84.

Referring now to FIG. 8, a second embodiment of torque multiplier assembly 62 is disclosed in which a greater than 2:1 ratio of torque multiplication is obtained. The second embodiment of the torque multiplier assembly 62 of FIG. 8 is substantially identical to the first embodiment of the torque multiplier assembly 62 of FIG. 7 with the exception that in the second embodiment of the torque multiplier assembly 62 ring gear 68 is fixed and output is from planet carrier 82. Thus, in operation of the second embodiment of the torque multiplier assembly 62 of the present invention, rotation of drill string 12 causes corresponding rotation of input shaft 70, sun gear 64, planet gear 66, planet carrier 82, and output shaft 84.

In the above two embodiments of torque multiplier assembly 82, either the ring gear 68 or planet carrier 82 is fixed by the torque reaction applied by the frictional forces of the wheel assemblies 46 and stabilizer legs 42. If the frictional forces are deemed inadequate to react the torque from torque multiplier assembly 62, the above-mentioned dulled roller cutter can be employed as wheel 50 to cut into the rock to increase the torque reaction capabiities.

Figure 9:
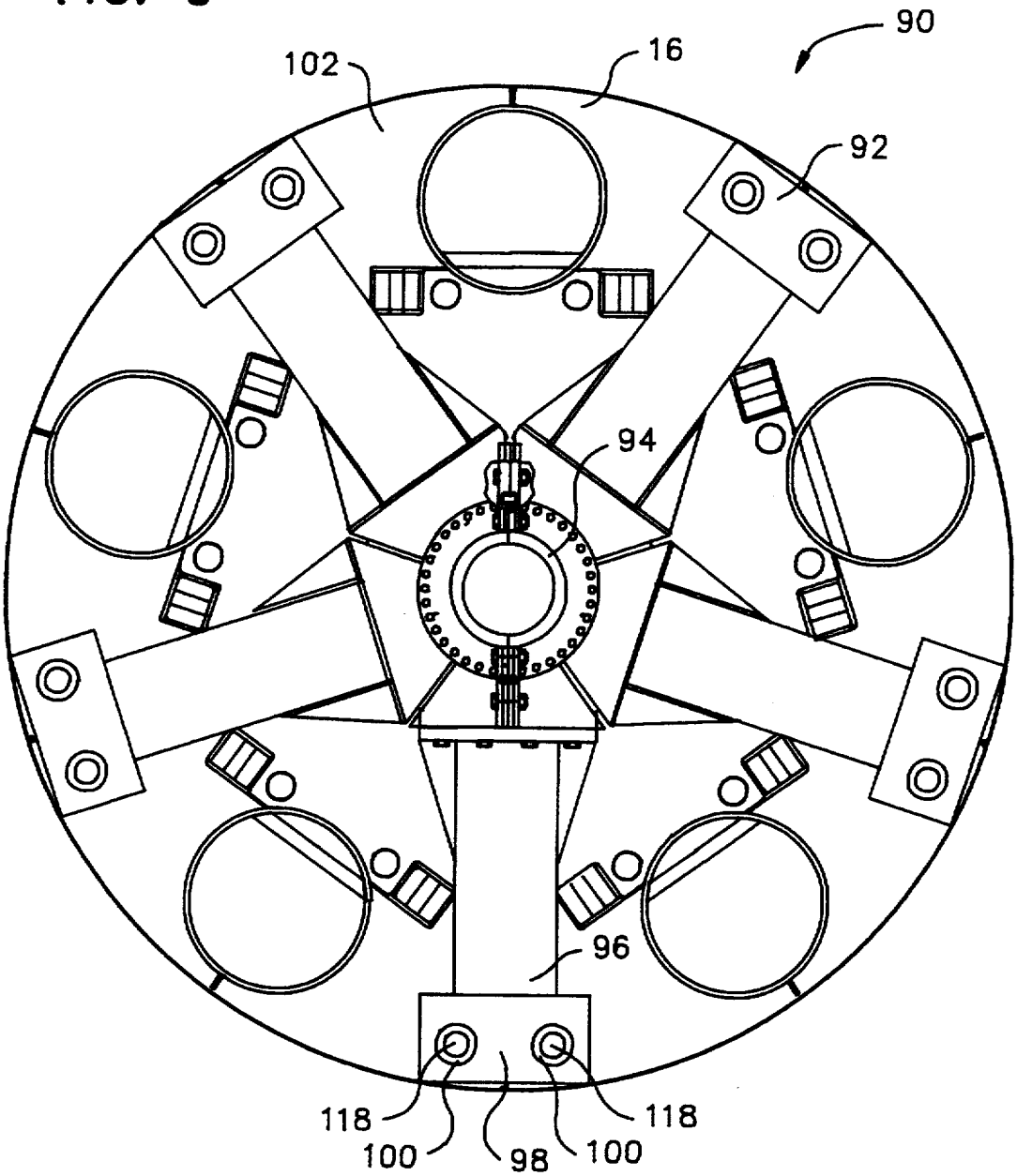
FIG. 9 is a cross-sectional view of the weight clamp and of the down boring apparatus of FIG. 1 taken along lines 9—9.
Figure 10:
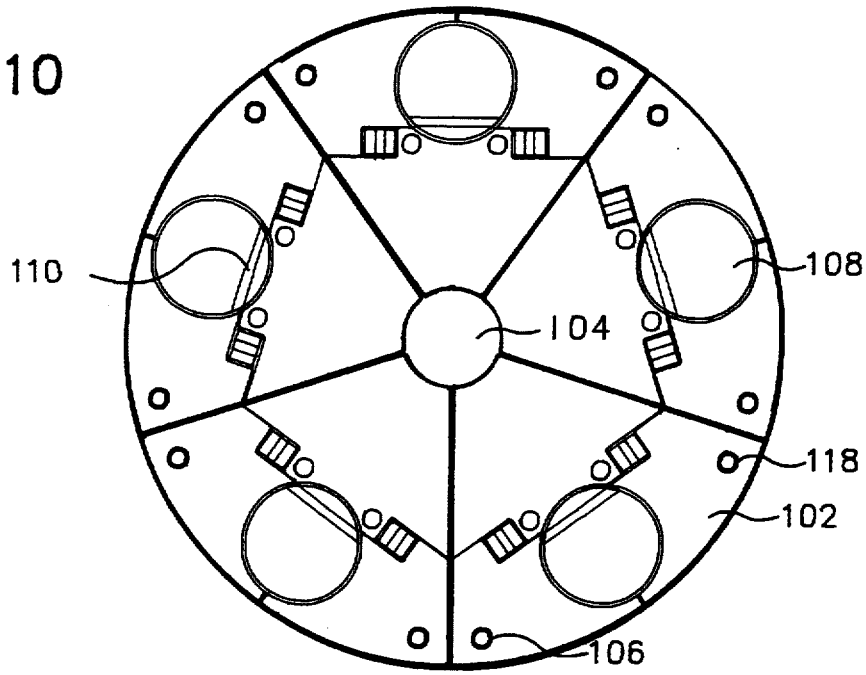
FIG. 10 is a cross-sectional view of the weight plates of the down boring apparatus of FIG. 1 taken along lines 10—10.
Figure 11:
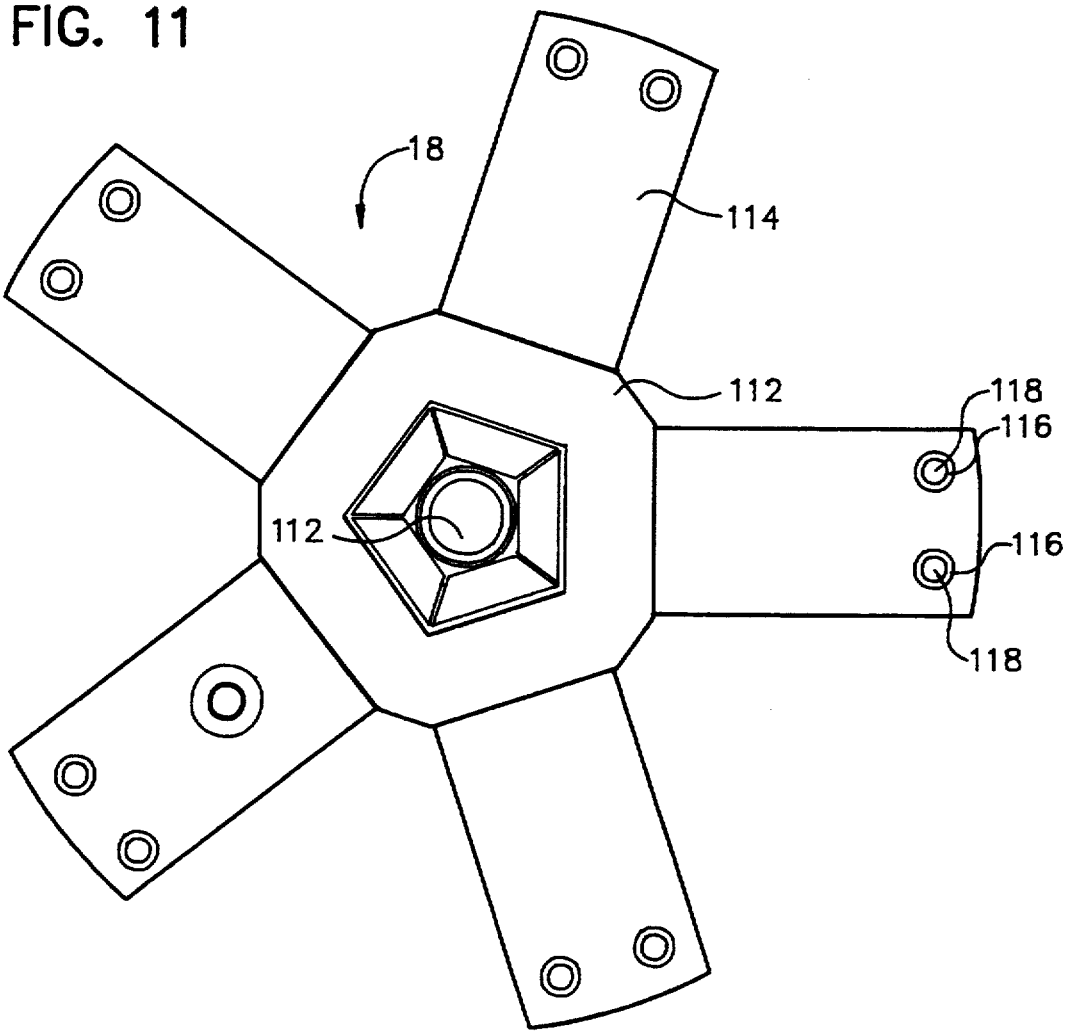
FIG. 11 is a cross-sectional view of the spider, or lower weight plate support, of the down boring apparatus of FIG. 1 taken along lines 11—11.

Referring now to FIGS. 9 through 11, weight assembly 90 of down reamer 10 is described in detail. Weight assembly 90 includes top weight clamp 92, positioned above a plurality of weight plates 16 and spider 18 oriented below weight plates 16. Spider 18 is also termable as a lower weight clamp. Referring to FIG. 9, upper weight clamp 92 includes weight clamp hub 94 oriented around drill string 12. A plurality of weight clamp arms 96 are radially disposed around weight clamp hub 94. Each of weight clamp arms 96 has a tie rod platform 98 on its end remote from weight clamp hub 94. Each tie rod platform 98 has one or more tie rod openings 100 therein.

Referring now to FIGS. 9 and 10, weight plates 16 of weight assembly 90 are described in detail. Each of weight plates 16 is comprised of a high mass material such as lead or a high mass metal alloy. Each weight plate 16 is preferaly comprised of a plurality of wedge shaped sections 102, which may be, for example, five in number. Wedge shaped sections 102 are radially disposed around opening 104 through which drill string 12 passes. Each of wedge shaped sections 102 has tie rod openings 106 therein which are adapted to be aligned with tie rod openings 100 of upper weight clamp 92. Additionally, one or more of wedge shaped sections 102 has a manway hole 108 therethrough. Manway hole 108 has rung 110 therein. Tie rod openings 106 and manway hole 108 are oriented in wedge shaped sections 102 of successive layers of stacked weight plates 16 such that tie rods can pass through the tie rod openings 102 in weight plates 16, and a manway is formed by the manway holes 108 of the stacked weight plates 16 such that an individual can pass therethrough to access cutterhead 28 for modification and/or maintenance thereof. Adjacent layers of weight plates 16 are preferably configured such that the wedge shaped sections 102 of each of the adjacent weight plates 16 are offset to maximize structure integrity of weigh assembly 90.

Now referring to FIG. 11, the spider 18, or lower weight clamp, of weight assembly 90 of down reamer 10 is described in detail. Spider 18 includes a spider hub 112 having a center portion in which stinger 20 of drill string 12 is securedly attached. A plurality of spider arms 114, preferably five in number, are radially disposed on spider hub 112. Each spider arm 114 has tie rod openings 116 passing therethrough. Tie rod openings 116 are oriented on each of spider arms 114 such that tie rod openings 116 are aligned with tie rod openings 106 of weight plates 116 and tie rod openings 100 of upper weight clamp 92 such that tie rods 118 pass through tie rod openings 100, 106, and 116. As shown in FIG. 1, tie rods 118 are secured through upper weight clamp 92, weight plates 16, and spider 18 of weight assembly 90 by jack 120. Thus, tie rods 118 secure weight plates 16 with upper weight clamp 92 and spider 18 of weight assembly 90 such that loads from rotation of cutterhead 28 are transmitted into weight assembly 90 as opposed to into stinger 20 of drill string 12. More specifically, rotation of drill string 12 results in rotation of upper weight clamp 92, weight plate 16 and spider 18 of weight assembly 90, as well as rotation of torque tube 24 and spider support arms 26 located between spider 18 and cutterhead 28, and also rotation of cutterhead 28. Thus, over-turning loads encountered by cutterhead 28 during boring pass from cutterhead 28 through torque tube 24 and spider support arms 26, and into weight assembly 90 and upper stabilizer 14 where the relatively larger diameter of weight plates 16, as compared to that of drill string 12, results in a greater section modulus which allows weight assembly 90 to withstand greater over-turning loads than drill string 12.

Figure 12:
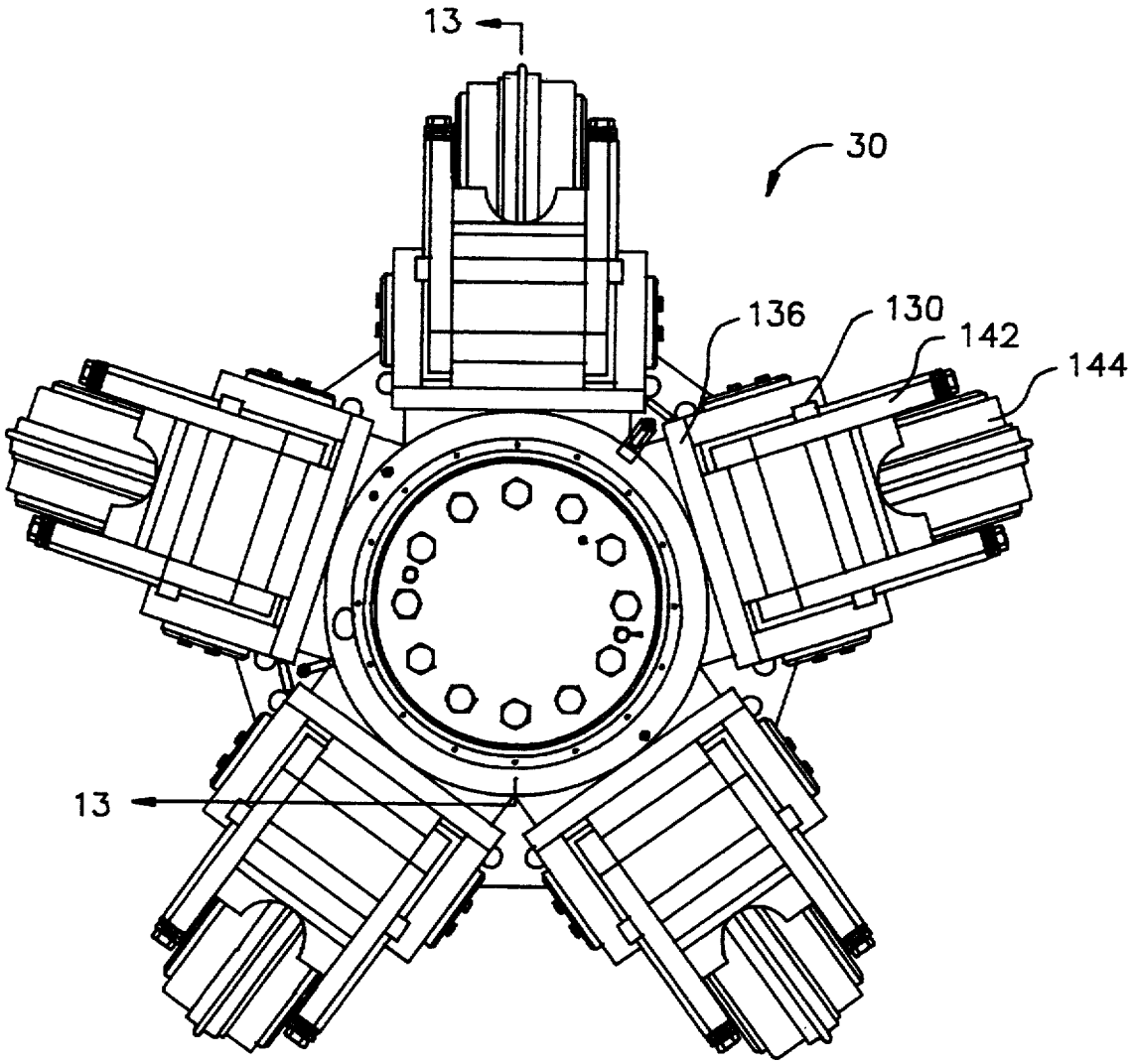
FIG. 12 is an end view of the lower stabilizer of the down boring apparatus typifying the present invention.
Figure 13:
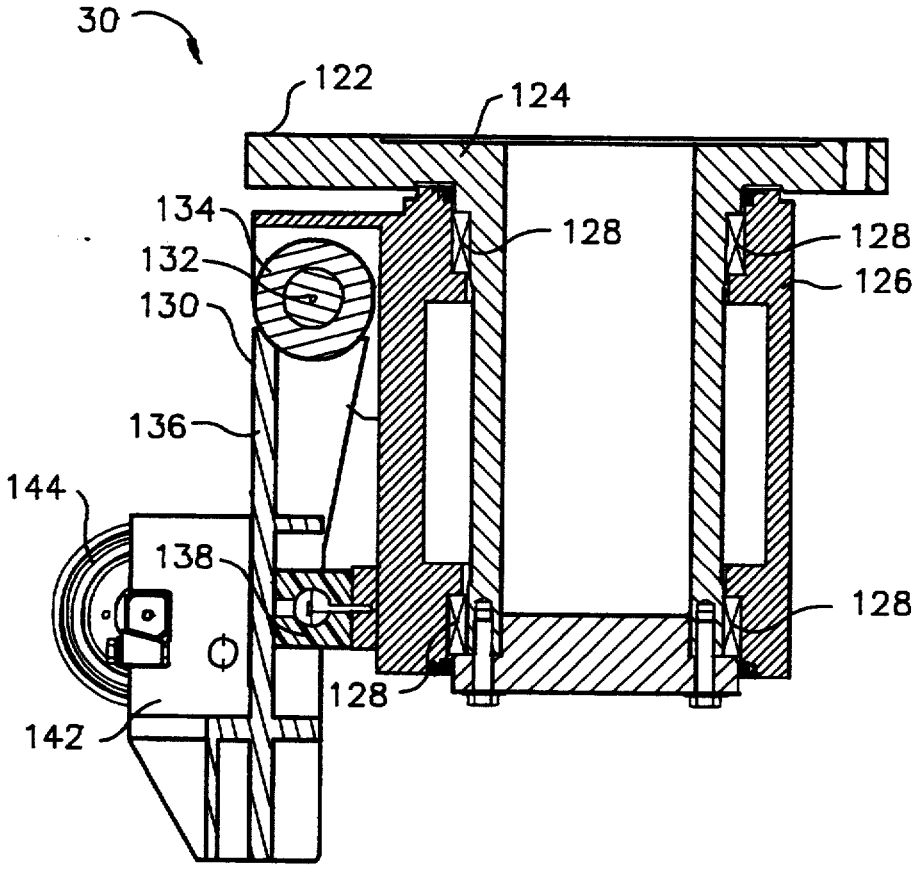
FIG. 13 is an enlarged view, partially in section, of the wheel assembly of the lower stabilizer of the down boring apparatus typifying the present invention.

Referring now to FIGS. 12 and 13, the lower stabilizer 30 of the down reamer 10 is described in detail. Lower stabilizer 30 includes a lower stabilizer hub 122 comprised of an inner race 124 fixedly secured to rotatable cutterhead 28 and an outer race 126 rotatably attached to inner race 124 by bearings 128. A plurality of wheel assemblies 130 are radially secured to outer race 126. Preferably five wheel assemblies 130 are present. Attachment of wheel assemblies 130 to outer race 126 is by means of pin 132, which is fixedly secured to outer race 126, and pivot sleeve 134 located over pin 132 which is rotatable therearound. Wheel arm 136 is attached to pivot sleeve 134 and is also supported on outer race 126 by a compressible bumper 138. Wheel arm 136 holds wheel mount 142 in which is located rotatable wheel 144.

In operation, as cutterhead 128 rotates, inner race 124 of lower stabilizer 30 rotates as well. However, outer race 126, and wheel assemblies 130 do not rotate with cutterhead 28. Rotatable wheels 144 contact the tunnel wall to provide stabilization for down reamer 10. As compressive forces are encountered by lower stabilizer 30 due, for example, to narrowing of the bored hole diameter, wheel arm 136 pivots on pivot sleeve 134 around pin 132 to stabilize down reamer 10. The length of the pivot stroke of wheel arm 136 is dictated by the degree of compressibility of bumper 138. Rotatable wheels 144 allow vertical movement of down reamer 10 while stabilization is provided by lower stabilizer 30. Rotatable wheels 144 can be, for example, dulled roller cutters known in the art, or, alternatively compressible tires with or without the above described overload wheels.

Figure 14:
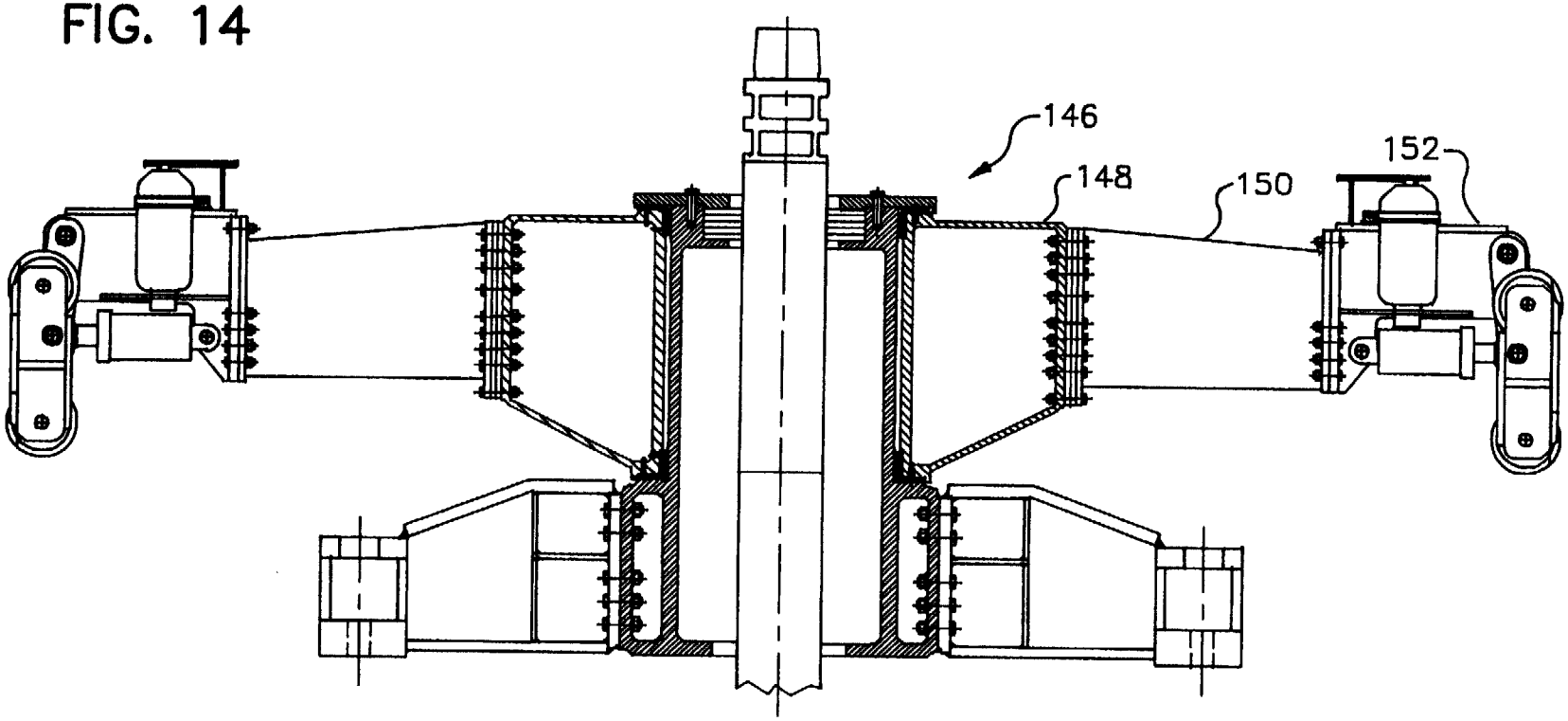
FIG. 14 is a side elevational view partially in section, of a second embodiment of the upper stabilizer of the down boring apparatus of the present invention having a plurality of shoe assemblies biased by pressurized pistons.

Referring now to FIGS. 14 through 20, a second embodiment of the upper stabilizer is now described. Upper stabilizer 146 is attached to drill string 12 in the same manner as previously described in connection with FIG. 2 which allows relative rotation of drill string 12 with respect to upper stabilizer 146. Referring to FIG. 14, upper stabilizer 146 is comprised of a plurality, preferably six, stabilizer legs 148 radially secured thereto. Stabilizer legs 148 optionally include leg extensions 150 bracketed between stabilizer legs 148 and stabilizer assembly 152. Leg extensions 150 can be of various predetermined lengths in order to enable down boring of shafts of various diameters.

Figure 15:
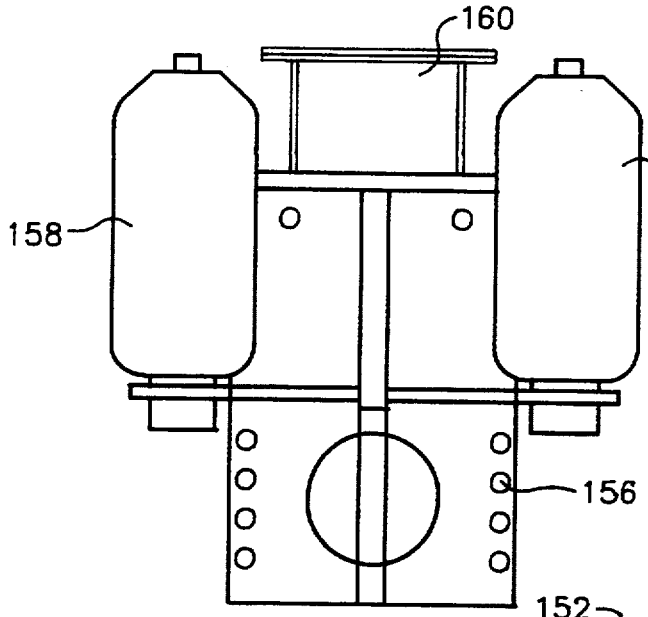
FIG. 15 is an end view of the shoe assembly and pressurized piston of the second embodiment of the upper stabilizer of the down boring apparatus of the present invention.
Figure 16:
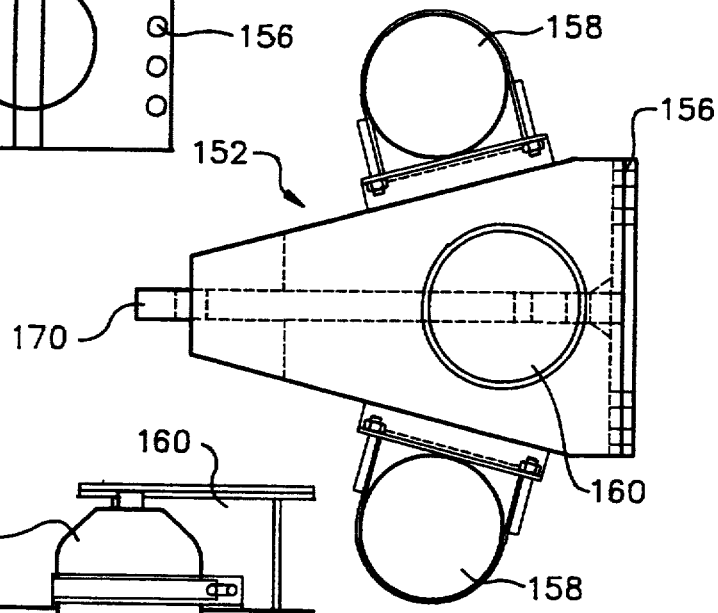
FIG. 16 is a top view of the shoe assembly and pressurized piston of the second embodiment of the upper stabilizer of the down boring apparatus of the present invention.
Figure 17:
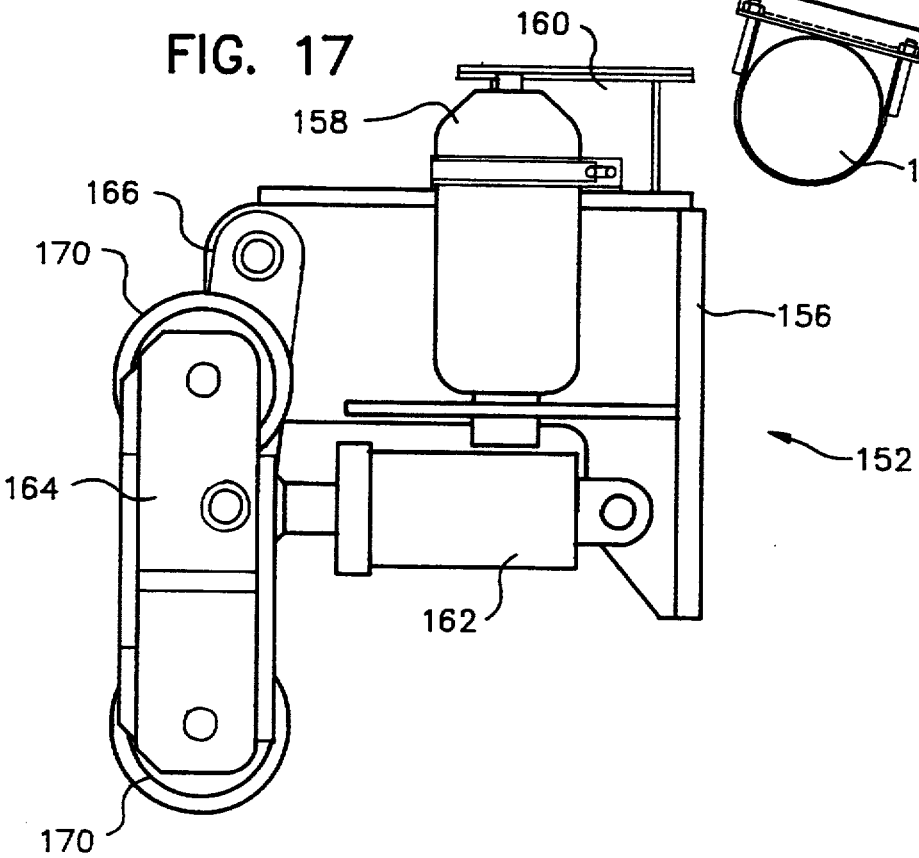
FIG. 17 is a side view of the shoe assembly and pressurized piston of the second embodiment of the upper stabilizer of the down boring apparatus of the present invention.

Now referring to FIGS. 15 through 17, stabilizer assembly 152 is comprised of stabilizer frame 156 which supports accumulator tanks 158, reservoir 160, hydraulic cylinder 162 and stabilizer shoe 164. More specifically, stabilizer shoe 164 is attached to stabilizer frame 156 by attachment to hydraulic cylinder 162 and pivotal attachment to pivot link 166. The pivotal attachment of stabilizer shoe 164 to pivot link 166 allows stabilizer shoe 164 to pivot relative to stabilizer frame 156 in order to accommodate for uneven tunnel wall surfaces. As described in further detail below, hydraulic cylinder 162 acts as a stiffening shock absorber which biases stabilizer shoe 164 against the shaft wall and allows limited, restricted return movement of stabilizer shoe 164 toward drill string 12 when, for example, the diameter of the shaft narrows.

Figure 18:
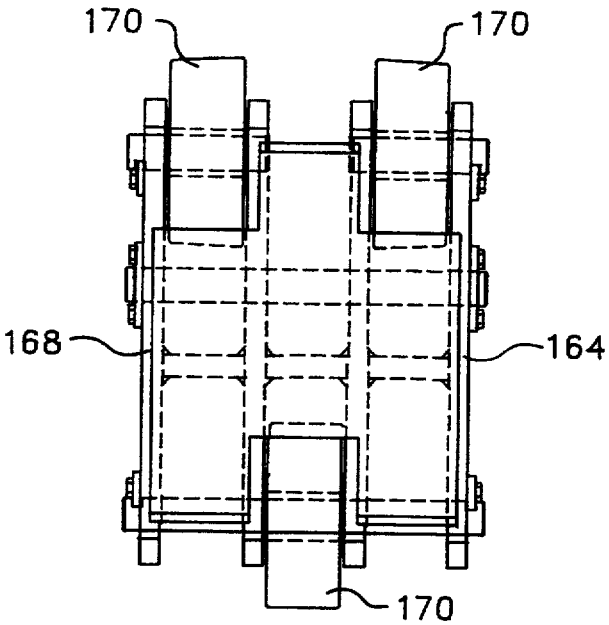
FIG. 18 is an enlarged end view of the shoe assembly of the second embodiment of the upper stabilizer of the down boring apparatus of the present invention.
Figure 19:
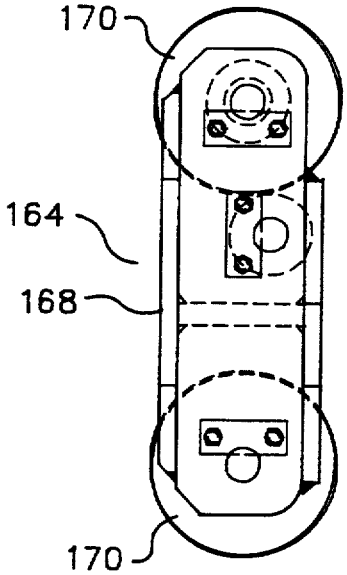
FIG. 19 is a side view of the shoe assembly of the second embodiment of the upper stabilizer of the down boring apparatus of the present invention.

Now referring to FIGS. 18 and 19, stabilizer shoe 164 preferrably includes shoe frame 168 which supports a plurality, preferably three, of rotatable metal wheels 170. More preferably, two metal wheels 170 are located at one longitudinal end of shoe frame 168 such that a metal wheel 170 is located at each side of this end of shoe frame 168. Additionally, the third metal wheel 170 is centrally located at the opposite end of shoe frame 168. The use of these metal wheels 170, as opposed to rubber tires, minimizes the "sponginess" of hydraulic stabilizer assembly 154 and, in conjunction with the bias provided by hydraulic cylinder 162, reduces the force reaction from the wheels when shaft walls of varying diameter are encountered. It is important to note that shoe frame 168 is almost flush with metal wheels 170 enabling shoe frame 168 to function essentially as a skid plate.

Figure 20:
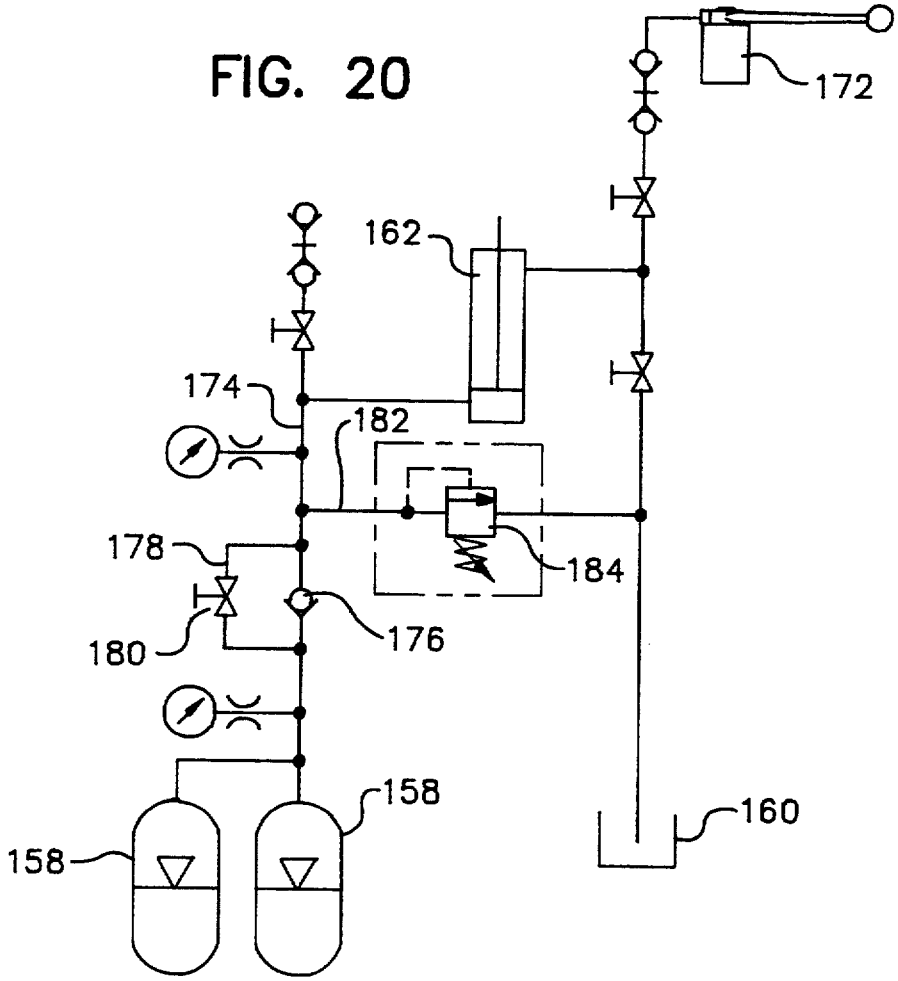
FIG. 20 is a hydraulic schematic of the fluid pressure system controlling the pressurized piston of the second embodiment of the upper stabilizer of the down boring apparatus of the present invention.

Now referring to FIG. 20, the hydraulic system of hydraulic stabilizer assembly 154 is next described in detail. The hydraulic system shown in FIG. 20 is a closed system employing pressurized nitrogen over hydraulic oil. This system functions to reduce the "bouncing" characteristics of stabilizer assemblies employing inflated rubber tires experience. The hydraulic system of the present invention acts such that hydraulic cylinder 162 functions as a stiffening shock absorber which biases stabilizer shoe 164 against the shaft wall and allows limited, restricted return movement of stabilizer shoe 164 toward drill string 12 when the shaft diameter narrows. The system is precharged with hand pump 172, providing hydraulic cylinder 162 with an internal pressure of between 400 psi and 1000 psi, and accumulator tanks 158 have a precharge pressure of about 500 psi. Accumulator tanks 158 contain nitrogen over oil with a 50% to 50% oil-to-nitrogen gas volumetric ratio. Line 174 connects hydraulic cylinder 162 to accumulator tanks 158 and has a one-way valve 176 therein which allows fluid flow only from accumulator tanks 158 to hydraulic cylinder 162 and does not allow fluid flow from hydraulic cylinder 162 to accumumlator tanks 158. Bypass line 178 circumvents one-way valve 176 and is connected to line 174. Bypass line 178 has metering valve 180 therein. Metering valve 180 is an element which can be employed to control fluid flow along bypass line 178. With metering valve 180 slightly open, bypass line 178 allows minimal fluid flow from hydraulic cylinder 162 along line 174, along line 178, and to accumulator tanks 158. The remainder of the fluid that does not travel from line 174 to 178 due to the limited flow allowed by metering valve 180 passes from line 174 to line 182 which leads to reservoir 160. Line 182 has relief valve 184 therein which functions as a safety valve preventing damage to accumulator tanks 158 and/or reservoir 160. Relief valve 184 preferably has a pressure range between about 300 psi and 4600 psi, and is most preferably set at about 3000 psi. In operation, when hydraulic cylinder 162 experiences a side wall force from stabilizer shoe 164, hydraulic piston 162 retracts, forcing fluid along line 174. Because one way valve 176 prevents fluid from flowing in line 174 to accumulator tanks 158, and because metering valve 180 allows only a limited amount of fluid to pass to accumulator tanks 158 along line 178, fluid passes from line 174 to line 182 where relief valve 184 provides high pressure resistance before the fluid passes to reservoir 160 over line 182. This high pressure resistance by relief valve 184 allows limited, restricted movement by hydraulic cylinder 162 in reaction to tunnel wall forces which, in turn, allows limited, restricted return movement by stabilizer shoe 164 toward drill string 12 when the shaft diameter narrows. However, after the force on hydraulic cylinder 162 has dissipated, for example when the shaft narrowing has been passed by, fluid from accumulator tanks 158 pass through line 174 and through one way valve 176 to hydraulic cylinder 162 to extend hydraulic cylinder 162 in this recovery mode. Note that neither metering valve 180 nor relief valve 184 directly participate in the recovery of hydraulic cylinder 162 and that hydraulic cylinder 162 is thus quickly reenergized to its original internal pressure. In other words, during reenergization, the damping or restriction provided by relief valve 184 is not present.

The hydraulic system of the present invention can be varied in three ways. First, the amount of internal pressure in hydraulic cylinder 162 can be varied by varying the pressure of the nitrogen over hydraulic oil in accumulator tanks 158. Second, the amount of fluid flowing through metering valve 180 in line 178 can be varied to vary the amount of oil returning to accumulator tank 158. Third, the pressure at which relief valve 184 in line 182 operates can be varied between about 300 psi and 4600 psi.

Figure 21:
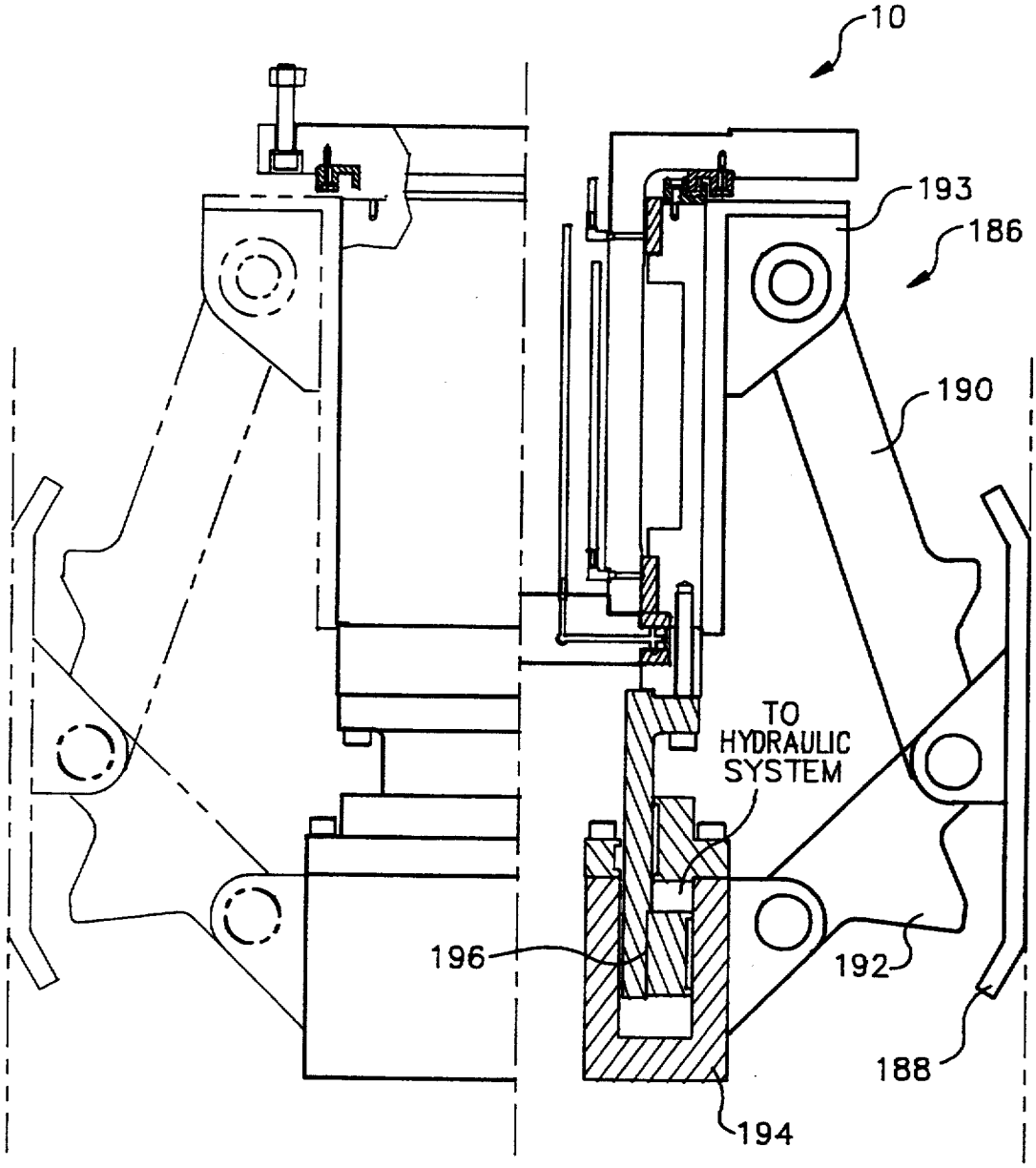
FIG. 21 is a side elevational view, partially in section, of a second embodiment of the lower stabilizer of the down boring apparatus of the present invention having a plurality of shoe assemblies biased by a pressurized piston.
Figure 22:
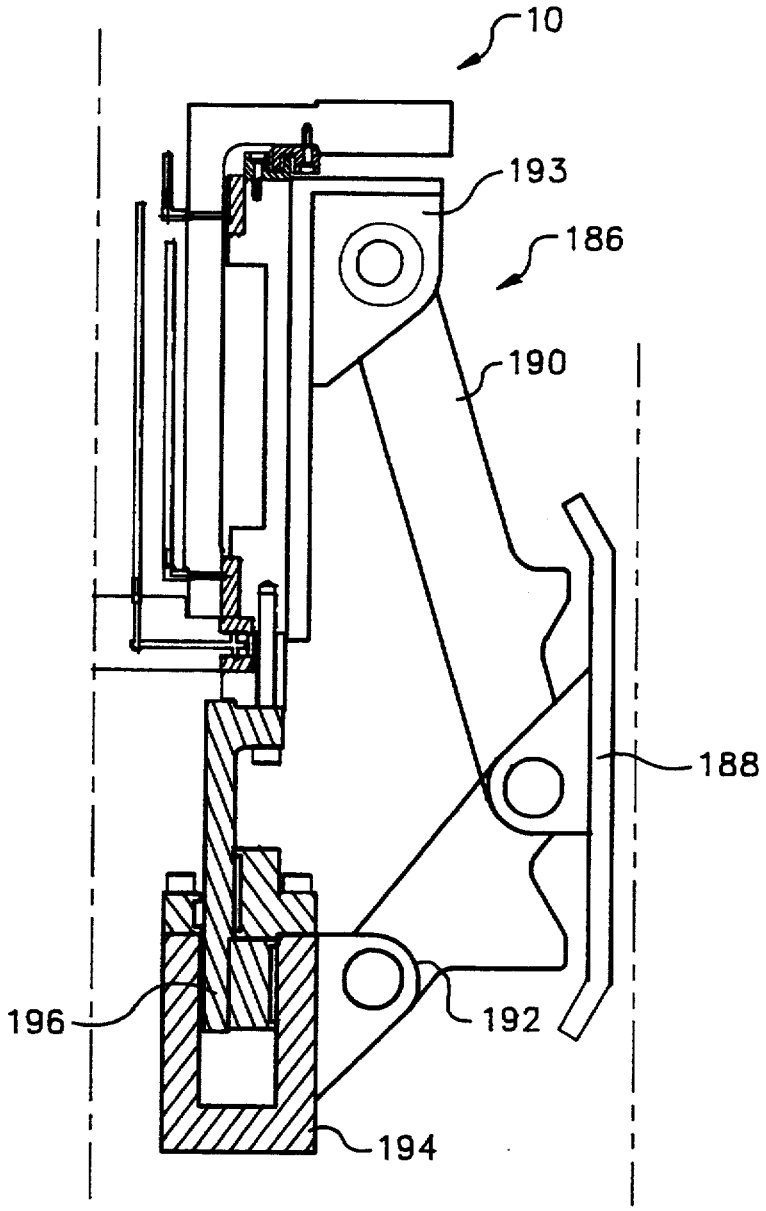
FIG. 22 is another side elevational view, partially in section, of a second embodiment of the lower stabilizer of the down boring apparatus of the present invention having a plurality of shoe assemblies biased by a pressurized piston.

Now referring to FIGS. 21 and 22, a second embodiment of the lower stabilizer of the present invention is next decribed. The hydraulic system of FIG. 20 described with regard to the second embodiment of the upper stabilizer of the present invention is also employed in this second embodiment of the lower stabilizer of the present invention of FIGS. 21 and 22. Lower hydraulic stabilizer assembly 186 includes stabilizer shoes 188, which are preferably five in number. Each of stabilizer shoes 188 is pivotally connected to upper shoe link 190 and lower shoe link 192. Upper shoe link 190 is pivotally connected to the exterior structure 193 of down reamer 10. This exterior structure 193 is stationary with respect to down reamer 10. Stabilizer shoe 188, upper shoe link 190, lower shoe link 192 and annular cylinder 194, which is connected to lower shoe link 192, are all movable relative to exterior structure 193. Annular cylinder 194 is extendable and retractable relative to annular piston 196, which is also connected to the exterior structure of down reamer 10. Annular piston 196 is therefore also stationary with respect to exterior structure 193 and down reamer 10. Stabilizer shoe 188, upper shoe link 190, lower shoe link 192 and annular cylinder 194 are all thus movable relative to annular piston 196. Note that instead of an annular cylinder and an annular piston, conventinal pistons and cylinder means may be employed.

As shown in FIG. 21, stabilizer shoe 188 is biased against the tunnel wall by pressurized hydraulic fluid between annular cylinder 194 and annular piston 196, such that annular cylinder 194 is configured in a first position in which it has retracted axially with respect to stationary annular piston 196. As shown in FIG. 22, when stabilizer shoe 188 encounters side wall force due to, for example, the narrowing of the shaft diameter the force is transmitted from stabilizer shoe 188, through upper shoe link 190 and lower shoe link 192, and to annular cylinder 194 which axially extends relative to annular piston 196. However, as in the case of the second embodiment of the upper stabilizer of the present invention, this extension by annular cylinder 194 is of a limited restricted type due to the above described functioning of the hydraulic system of FIG. 20. Finally, after the side wall force has dissipated, the hydraulic system of the present invention returns annular cylinder 194 to the retracted configuration of FIG. 21 in which stabilizer shoe 188 is configured in its original position.

The above described embodiments are intended to be descriptive, not restrictive. The full scope of the invention is described by the claims, and any and all equivalents are included.

What is claimed is:

1. A reamer head for a rock boring machine adapted to be attached to a drill string, said reamer head having a frame and a rotatable cutterhead, and comprising:

an upper stabilizer having a hub, and a plurality of stabilizer assemblies radially attached to said hub, each of said stabilizer assemblies having an arm attached to said hub, and having shoe means attached to said arm by a liquid biasing means, said liquid biasing means allowing movement of said shoe means relative to said arm, said liquid biasing means including liquid line means having substantially unrestricted liquid flow in a first direction to urge said shoe means against a bored shaft wall and having partially restricted liquid flow in a second, opposite direction to provide limited return movement with resistance of said shoe means toward said arm;

a weight assembly; and a lower stabilizer having a radially attached shoe means which supports said reamer head in the bored shaft.

2. The reamer head of claim 1, wherein said biasing means comprises:

a liquid pressurized cylinder attached to said shoe means;

a liquid accumulator communicating with said cylinder;

a liquid tank communicating with said cylinder and said accumulator;

means for controlling liquid flow between said cylinder and said liquid tank; and means for controlling liquid flow between said cylinder and said accumulator whereby external pressure on said shoe means retracts said cylinder causing liquid to pass to said accumulator and said liquid tank, said means for controlling liquid flow between said cylinder and said liquid tank allowing only liquid of a first predetermined pressure to pass to said liquid tank, and whereby said accumulator passes liquid of a second predetermined pressure to said cylinder to extend said cylinder after retraction.

3. The reamer head of claim 2, wherein said means for controlling liquid flow between said cylinder and said liquid tank is a relief valve having a variable pressure range.

4. The reamer head of claim 2, wherein said means for controlling liquid flow between said cylinder and said accumulator comprises a one way valve allowing liquid flow from said accumulator to said cylinder and a metering valve allowing a predetermined limited liquid flow from said cylinder to said accumulator.

5. The reamer head of claim 1, wherein each of said shoe means has wheels which contact the bored shaft wall.

6. The reamer head of claim 1, wherein said upper stabilizer further comprises removable leg extension means located between said arm and said shoe means.

7. The reamer head of claim 1, wherein said upper stabilizer further comprises a torque multiplier assembly in said upper stabilizer hub, said torque multiplier assembly comprising:

rotatable input shaft means attached to the drill string;

sun gear means meshed with said input shaft means;

planet gear means meshed with said sun gear means and supported by planet carrier means;

ring gear means meshed with said planet gear means; and rotatable output shaft means whereby rotation of said input shaft means causes rotation of said output shaft means with torque greater than that of said input shaft means.

8. The reamer head of claim 7, wherein said ring gear means is rotatable and is meshed with said output shaft means, and said planet carrier means is not rotatable.

9. The reamer head of claim 7, wherein said planet carrier means is rotatable and is meshed with said output shaft, and said ring gear means is not rotatable.

10. The reamer head of claim 1, wherein said weight assembly includes a plurality of plates and each of said plates of said weight assembly includes an opening therethrough, each of said openings being oriented in each of said plates such that said openings are aligned to form a manway upon stacking of said plates.

11. The reamer head of claim 10, wherein the cutterhead of the rock boring apparatus has a plurality of cutter assemblies and said manway of said weight assembly provides access to the cutterhead to reconfigure the cutter assemblies.

12. The reamer head of claim 1, wherein said weight assembly includes a plurality of plates and each of said plates is comprised of a plurality of wedge-shaped sections.

13. The reamer head of claim 12, wherein said wedge-shaped sections of each layer of said plates are radially off-set from said wedge-shaped sections of each adjoining layer of said plates.

14. The reamer head of claim 1, wherein said weight assembly has tie rods passing through a plurality of plates and has means for securing said tie rods of said weight assembly, said means for securing said tie rods of said weight assembly comprising:

a top weight clamp having tie rod openings therein, said top weight clamp adapted to be oriented above said plates;

a bottom weight clamp having tie rod openings therein, said bottom weight clamp adapted to be oriented below said plates and to fixedly hold an end of each of said tie rods; and jack means attached to said tie rods such that said tie rods are oriented through said tie rod openings of said plates, said top weight clamp and said bottom weight clamp, and said jack means applies a compressive force against said plates to secure said plates on the frame of said reamer head.

15. A stabilizer for a rock boring machine adapted to be attached to a drill string, said stabilizer comprising:

a stabilizer hub; and a plurality of stabilizer assemblies radially attached to said hub, each of said stabilizer assemblies having an arm attached to said hub, and having shoe means attached to said arm by a liquid biasing means, said liquid biasing means allowing movement of said shoe means relative to said arm, said liquid biasing means including liquid line means having substantially unrestricted liquid flow in a first direction to urge said shoe means against a bored shaft wall and having partially restricted liquid flow in a second, opposite direction to provide limited return movement with resistance of said shoe means toward said arm.

16. The stabilizer of claim 15, wherein said biasing means comprises:

a liquid pressurized cylinder attached to said shoe means;

a liquid accumulator communicating with said cylinder;

a liquid tank communicating with said cylinder and said accumulator;

means for controlling liquid flow between said cylinder and said liquid tank; and means for controlling liquid flow between said cylinder and said accumulator whereby external pressure on said shoe means retracts said cylinder causing liquid to pass to said accumulator and said liquid tank, said means for controlling liquid flow between said cylinder and said liquid tank allowing only liquid of a first predetermined pressure to pass to said liquid tank, and whereby said accumulator passes liquid of a second predetermined pressure to said cylinder to extend said cylinder after retraction.

17. The stabilizer of claim 16, wherein said means for controlling liquid flow between said cylinder and said liquid tank is a relief valve having a variable pressure range.

18. The stabilizer of claim 16, wherein said means for controlling liquid flow between said cylinder and said accumulator comprises a one way valve allowing liquid flow from said accumulator to said cylinder and a metering valve allowing a predetermined limited liquid flow from said cylinder to said accumulator.

19. The stabilizer of claim 15, wherein each of said shoe means has wheels which contact the bored shaft wall.

20. The stabilizer of claim 15, further comprising removable leg extension means located between said arm and said shoe means.

21. The stabilizer of claim 15, further comprising a torque multiplier assembly in said stabilizer hub, said torque multiplier assembly comprising:

rotatable input shaft means attached to the drill string;

sun gear means meshed with said input shaft means;

planet gear means meshed with said sun gear means and supported by planet carrier means;

ring gear means meshed with said planet gear means; and rotatable output shaft means whereby rotation of said input shaft means causes rotation of said output shaft means with torque greater than that of said input shaft means.

22. The stabilizer of claim 21, wherein said ring gear means is rotatable and is meshed with said output shaft means, and said planet carrier means is not rotatable.

23. The stabilizer of claim 21, wherein said planet carrier means is rotatable and is meshed with said output shaft, and said ring gear means is not rotatable.

24. A reamer head for a rock boring machine adapted to be attached to a drill string, said reamer head having a frame and a rotatable cutterhead, and comprising:

an upper stabilizer having radially attached shoe means which support said reamer head in a bored shaft;

a weight assembly; and a lower stabilizer having a hub and a plurality of shoe means radially attached to a plurality of arms, and having biasing means attaching said arms to said hub, said biasing means allowing radial movement of said shoe means and said arms relative to said hub, said biasing means including liquid line means having substantially unrestricted liquid flow in a first direction to urge said shoe means against a bored shaft wall and having partially restricted liquid flow in a second, opposite direction to provide limited return movement with resistance of said shoe means toward said arm.

25. The reamer head of claim 24, wherein said biasing means comprises:

a liquid pressurized cylinder attached to said shoe means;

a liquid accumulator communicating with said cylinder;

a liquid tank communicating with said cylinder and said accumulator;

means for controlling liquid flow between said cylinder and said liquid tank; and means for controlling liquid flow between said cylinder and said accumulator whereby external pressure on said shoe means retracts said cylinder causing liquid to pass to said accumulator and said liquid tank, said means for controlling liquid flow between said cylinder and said liquid tank allowing only liquid of a first predetermined pressure to pass to said liquid tank, and whereby said accumulator passes liquid of a second predetermined pressure to said cylinder to extend said cylinder after retraction.

26. The reamer head of claim 25, wherein said means for controlling liquid flow between said cylinder and said liquid tank is a relief valve having a variable pressure range.

27. The reamer head of claim 25, wherein said means for controlling liquid flow between said cylinder and said accumulator comprises a one way valve allowing liquid flow from said accumulator to said cylinder and a metering valve allowing a predetermined limited liquid flow from said cylinder to said accumulator.

28. A stabilizer for a rock boring machine adapted to be attached to a drill string, said stabilizer comprising:

a stabilizer hub;

a plurality of shoe means radially attached to a plurality of arms; and liquid biasing means attaching said arms to said hub, said liquid biasing means allowing radial movement of said shoe means and said arms relative to said hub, said liquid biasing means including liquid line means having substantially unrestricted liquid flow in a first direction to urge said shoe means against a bored shaft wall and having partially restricted liquid flow in a second, opposite direction to provide limited return movement with resistance of said shoe means toward said arm.

29. The stabilizer of claim 28, wherein said biasing means comprises:

a fluid pressurized cylinder attached to said shoe means;

a fluid accumulator communicating with said cylinder;

a fluid tank communicating with said cylinder and said accumulator;

means for controlling fluid flow between said cylinder and said fluid tank; and means for controlling fluid flow between said cylinder and said accumulator whereby external pressure on said shoe means retracts said cylinder causing fluid to pass to said accumulator and said fluid tank, said means for controlling fluid flow between said cylinder and said fluid tank allowing only fluid of a first predetermined pressure to pass to said fluid tank, and whereby said accumulator passes fluid of a second predetermined pressure to said cylinder to extend said cylinder after retraction.

30. The stabilizer of claim 29, wherein said means for controlling fluid flow between said cylinder and said fluid tank is a relief valve having a variable pressure range.

31. The stabilizer of claim 29, wherein said means for controlling fluid flow between said cylinder and said accumulator comprises a one way valve allowing fluid flow from said accumulator to said cylinder and a metering valve allowing a predetermined limited fluid flow from said cylinder to said accumulator.

* * * * *